US009423208B1

(12) United States Patent
Mahmalji

(10) Patent No.: US 9,423,208 B1
(45) Date of Patent: Aug. 23, 2016

(54) VERTICAL FOREGRIP PEPPER SPRAY DEVICE

(71) Applicant: Alan J. Mahmalji, Westminster, CA (US)

(72) Inventor: Alan J. Mahmalji, Westminster, CA (US)

( * ) Notice: Subject to any disclaimer, the term of this patent is extended or adjusted under 35 U.S.C. 154(b) by 0 days.

(21) Appl. No.: 14/998,420

(22) Filed: Jan. 2, 2016

(51) Int. Cl.
*F41C 23/16* (2006.01)
*F41C 23/22* (2006.01)
*F41H 9/10* (2006.01)

(52) U.S. Cl.
CPC ..... *F41C 23/16* (2013.01); *F41C 23/22* (2013.01); *F41H 9/10* (2013.01)

(58) Field of Classification Search
CPC ..... F41C 23/16; F41C 23/22; F41C 9/10; F41B 11/81; F41H 9/10
USPC ..... 42/71.01, 1.08; 222/79, 192; 124/55
See application file for complete search history.

(56) References Cited

U.S. PATENT DOCUMENTS 4,058,921 A * 11/1977 Mason ..... F41C 23/10 222/79
4,316,338 A * 2/1982 Mason ..... F41C 23/10 222/79
5,405,134 A * 4/1995 Wolfram ..... F21V 33/0064 222/175
5,549,220 A * 8/1996 Whalen ..... B05B 9/0805 116/81
5,671,559 A * 9/1997 Ludaesher ..... F41H 9/10 222/79
5,787,628 A 8/1998 Teetzel
5,983,548 A * 11/1999 Ludaescher ..... F41H 9/10 42/1.08
6,026,990 A * 2/2000 Brunswig ..... F21V 33/0064 222/153.13
6,052,051 A * 4/2000 Whalen ..... F41H 9/10 222/1
6,546,661 B1 * 4/2003 Staubs ..... F41H 9/10 102/367
6,658,779 B2 * 12/2003 Bauer ..... F41H 9/10 222/79
7,111,424 B1 * 9/2006 Moody ..... F41A 23/08 248/171
7,121,432 B2 * 10/2006 Kostal ..... F41H 9/10 222/113
7,644,839 B2 * 1/2010 McNulty, Jr. ..... F41B 9/00 222/162
9,022,255 B1 * 5/2015 Calvert ..... F41H 9/10 222/79
9,170,073 B2 10/2015 Mangold
2005/0188827 A1 * 9/2005 McNulty, Jr. ..... F41B 15/04 89/1.11
2006/0120009 A1 6/2006 Chudy, II
2007/0194048 A1 * 8/2007 Teig ..... F21V 33/0076 222/113
2010/0229448 A1 * 9/2010 Houde-Walter ..... F41C 23/16 42/72
2011/0047851 A1 * 3/2011 Mock ..... F41C 23/16 42/72
2011/0210146 A1 * 9/2011 Dapper ..... F41H 9/10 222/113
2012/0272557 A1 * 11/2012 Yan ..... F41C 23/12 42/69.01
2013/0333263 A1 * 12/2013 Hovey ..... F41C 23/16 42/72
2014/0048561 A1 * 2/2014 Mangold ..... F41C 27/00 222/153.11
2014/0182182 A1 * 7/2014 Adcock, Jr. ..... F41C 27/16 42/72
2014/0215887 A1 * 8/2014 Luckey ..... F41G 11/003 42/90
2014/0252028 A1 * 9/2014 Lord ..... G08B 21/02 222/79
2014/0360079 A1 * 12/2014 Iannello ..... F41G 11/003 42/90
2015/0083749 A1 * 3/2015 Ben Yair ..... F41H 9/10 222/79
2015/0121737 A1 * 5/2015 Anderson ..... F41C 23/16 42/72
2015/0300775 A1 * 10/2015 Combs ..... F41C 23/16 42/72
2015/0312399 A1 * 10/2015 Teig ..... H04M 1/72541 455/404.2

* cited by examiner

*Primary Examiner* — Joshua Freeman
(74) *Attorney, Agent, or Firm* — Gordon K. Anderson

(57) ABSTRACT

A vertical foregrip pepper spray device is taught which consists of a hollow body having a base with an internal fluid conduit incorporated therein. The device has a picatinny rail female groove and a thumb opening containing a covered safety mechanism in the top portion. A pepper spray pressurized aerosol container is inserted within the hollow of the body and latched in place, such that an operator may safely discharge a non-lethal chemical irritant spray by manually depressing the top surface of the pressurized aerosol container. The device is removably mounted, with a quick release assembly, onto a picatinny rail positioned on the forearm underside of a modern sporting rifle or long gun.

15 Claims, 4 Drawing Sheets

VERTICAL FOREGRIP PEPPER SPRAY DEVICE

TECHNICAL FIELD

The present invention relates to pepper spray devices in general. More specifically to a vertical foregrip for a rifle with a pepper spray canister inside and activating provisions to discharge the pepper spray.

BACKGROUND ART

Previously, many types of pepper spray devices have been used in endeavoring to provide an effective means for non-lethal self protection.

The prior art listed below did not disclose patents that possess any of the novelty of the instant invention; however the following U.S. patents are considered related:

Patent Number Inventor Issue Date
U.S. Pat. No. 9,170,073 B2 Mangold Oct. 27, 2015
U.S. Pat. No. 7,644,839 B2 McNulty, Jr. Jan. 12, 2010
2006/0120009 A1 Chudy, II Jun. 8, 2006
U.S. Pat. No. 6,658,779 B2 Bauer et al. Dec. 9, 2003
U.S. Pat. No. 6,546,661 B1 Staubs Apr. 15, 2003
U.S. Pat. No. 5,983,548 Lidaescher Nov. 16, 1999
U.S. Pat. No. 5,787,628 Teetzel Aug. 4, 1998

Mangold in U.S. Pat. No. 9,170,073 B2 teaches a rifle or pistol slide activated mounted pepper spray device that attached to a picatinny rail. A can of pepper spray slips into a grip that activates the pepper spray when it is pulled toward the user. A lock system and a buffer spring are included.

U.S. Pat. No. 7,644,839 B2 issued to McNulty, Jr. reveals a housing for mounting on a pistol, or other weapon, also used by itself. A canister is installed in the housing and releases an irritant spray when a digit is pressed against the side of the storage cylinder. The housing needs no other mechanisms except the housing and canister. In some other embodiments an actuator compresses a spring-loaded pusher to move the cylinder in the longitudinal axis to release the spray.

Bauer et al. in U.S. Pat. No. 6,658,779 B2 discloses a weapon system with a firearm barrel that may propel a projectile and also non-lethal means ejecting a stream of fluid parallel to the barrel. The system houses a pressurized canister with a nozzle for the release of a fluid. The canister, nozzle and trigger may be removably mounted on said firearm.

Lidaescher in U.S. Pat. No. 5,983,548 teaches a combination lethal/non-lethal firearm which fires bullets and a canister unit attachment for tear gas or pepper gas. A top portion is attached to the underside and trigger guard of the firearm. A force pad on the trigger guard communicates with an actuating button on the canister propelling the chemical agent.

U.S. Pat. No. 5,787,628 issued to Teetzel is for an apparatus fitted to handguns and rifles. The apparatus utilizes a chassis containing a chemical module that houses MACE or tear gas. For a conventional handgun the hand grips are replaced with electronic controls, waterproof switches and a power source. The apparatus can also be activated at a distance from the firearm using an infrared activation control.

For background purposes and as indicative of the art to which the invention is related reference may be made to the remaining cited patent application publication and patent issued to Chudy, II 2006/0120009 A1 and Staubs U.S. Pat. No. 6,546,661 B1.

DISCLOSURE OF THE INVENTION

The use of a vertical pistol grip on the forearm of a rifle has been vastly popular for some time in this country since the AR type of firearms have been available in all states. Many pistol grip configurations have been used in size and shape, such as straight, hinged laterally or hinged longitudinally, stout, cylindrical and ergonomically with all sharing the same attachment to a picatinny rail. Non-lethal sprays have been on the market for decades with all types of atomized liquids such as the well known tear gas, MACE, so called (CN) and (CS) sprays including the now current (OC) pepper spray. A myriad of holders and dispensers are presently marketed for accepting a cartridge or, aerosol container holding the spray media. These devices include additional items that are connected to or essentially incorporated within, such as a flat base, finger grooves, a belt clip, a key chain, a key ring and straps with hook and loop closures as well as other useful configurations and superficial enhancements.

It is therefore the primary object and novelty of the invention is to incorporate two separate functions or uses in the same device. The utility of having a vertical pistol grip on a specific type of firearm is well known and presently utilized by many. The addition of a non-lethal spray is indeed new, novel and unique. While the AR type firearms are ideal in configuration as the later models include a free float handguard having a built in picatinny rail on multiple sides, at least on the top and bottom. Other existing rifle and long guns could easily be modified by the addition of a picatinny rail on the bottom of the stock fore end.

An important aspect of the invention provides a non-lethal option which is already incorporated within the vertical pistol grip. Firing the rifle with live ammunition would be used only as the last resort. This aspect is particularly applicable to law enforcement, however for self defense the same function and benefit is achieved. It is easy to modify an AR type firearm to contain an attachment rail to the bottom of the forearm by simply replacing the existing handguard with an aftermarket quad free-float handguard in the carbine, mid length and rifle length.

Another attribute of the invention sprays from bottom of grip, and operates in any position, upright, upside down, or sideways and everything in between. The majority of containers holding liquid, and the like, have a quill that penetrates to its bottom permitting the media to be forced to the top by the pressure of the propellant. Conversely the instant invention utilizes a container that separates the pepper spray media from the propellant such that the pepper spray pressurized aerosol container is operable in any angular displacement. This functional operation is particularly important to law enforcement personnel.

Still another feature of the invention is that the foregrip pepper spray device may be released easily and quickly utilizing a quick release assembly which consists of an eccentric cam handle complete with an attached threaded rod, a separate rail keeper and a separate knurled nut. The cam action locks the rod against the nut holding the keeper in place. Relocating the device is also easy if more than one person is using the same firearm and requires the distance between the buttstock foregrip to be changed allowing the device to be comfortably positioned.

A further aspect of the invention is the straightforward insertion and replacement of the aerosol container. When the container is originally installed within the device it is not attached and would be resting on its base. The container is inserted into the hollow top of the body until the retaining latch snaps over the containers bottom rim and simultaneously the outlet stem enters the stem chamber over the O-rings creating a seal. To replace the container the device is removed from the firearm rail with the quick release assembly and the operator inserts a finger into the hollow of the body and presses the retaining latch to unlock the container which is manually pulled out through the top of the device.

An attribute of the invention is in the safe and easy way to operate the device. When the device is installed on the picatinny rail the operators hand grips the body with his fingers wrapped around the cylindrical portion and the thumb engages the safety mechanism. If an occurrence demands the device to be activated and eject the pepper spray forward, the operator then removes his thumb from the safety mechanism and inserts it into the thumb opening formed within the body moving the safety away against slight spring pressure. At the same time the operator presses the top of the container downwardly until the outlet stem is forced inwardly ejecting the pepper spray through the internal conduit onto the outlet orifice.

A final feature of the device that it is ambidextrous in that the device is triggered with the thumb and as both sides of the hollow body contains a thumb opening it makes no difference which thumb is used an there is no need to create directions as it is intuitively obvious in function.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
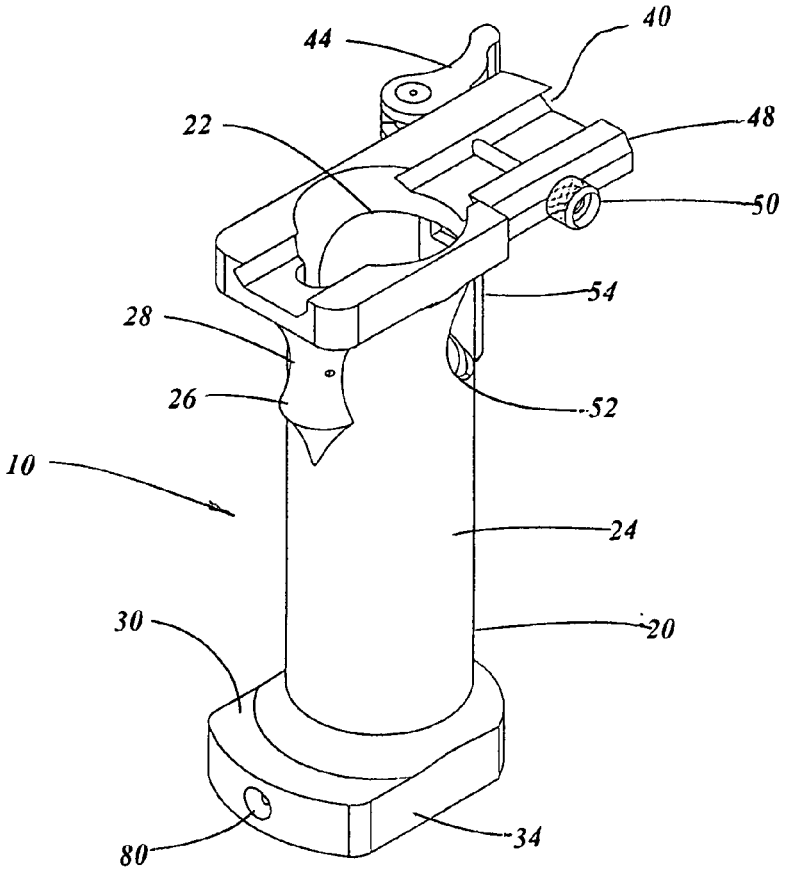
FIG. 1 is an isometric view of the vertical foregrip pepper spray device in the preferred embodiment.

The best mode for carrying out the invention is presented in terms of a preferred embodiment. This preferred embodiment is shown in FIGS. 1 thorough 11 and is comprised of a hollow body 20 with a cylindrical portion 22 providing a vertical gripping surface 24 for an operator along with dispensing a volume of pepper spray. A raised forefinger grip 26 and an indentation 28 are integrally formed on the forward upper outside surface of the hollow body 20. The hollow body is made of a material such as aluminum, impact resilient polymer or thermoplastic overmolded on a metallic body, however other materials suitable for the purpose may be used with equal utility.

Figure 3:
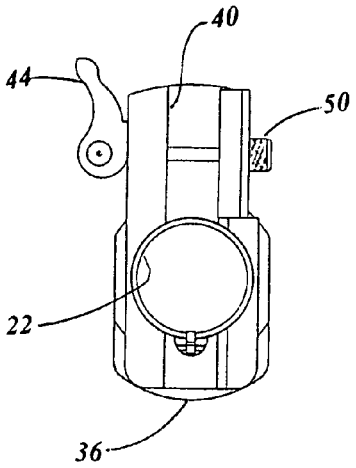
FIG. 3 a top view of the vertical foregrip pepper spray device in the preferred embodiment.
Figure 4:
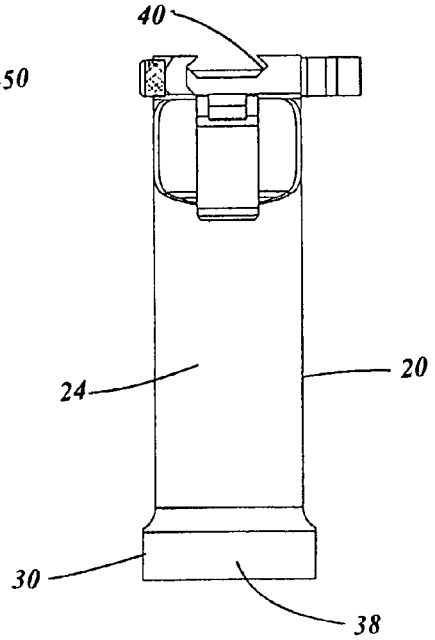
FIG. 4 a rear view of the vertical foregrip pepper spray device in the preferred embodiment.
Figure 5:
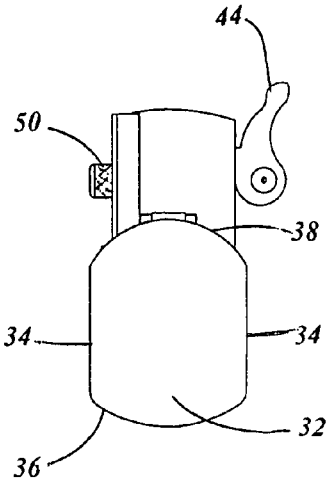
FIG. 5 a bottom view of the vertical foregrip pepper spray device in the preferred embodiment.
Figure 6:
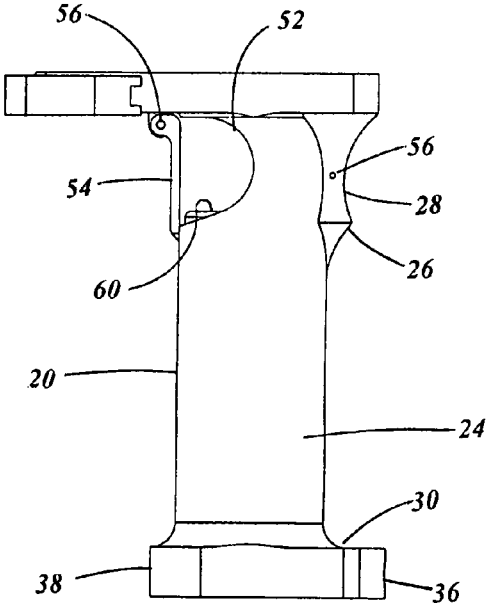
FIG. 6 a right side view of the vertical foregrip pepper spray device in the preferred embodiment.
Figure 7:
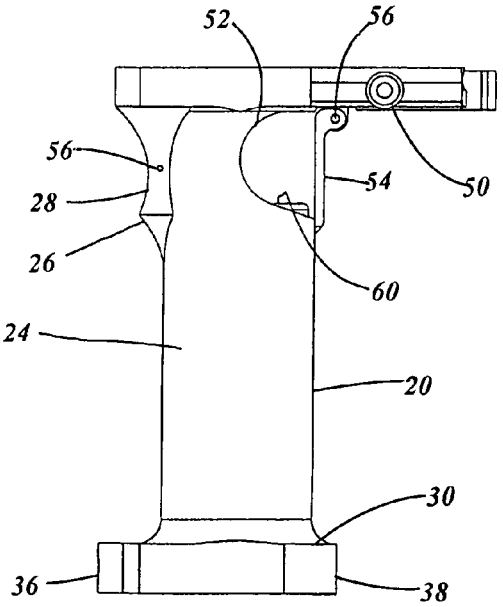
FIG. 7 a left side view of the vertical foregrip pepper spray device in the preferred embodiment.
Figure 8:
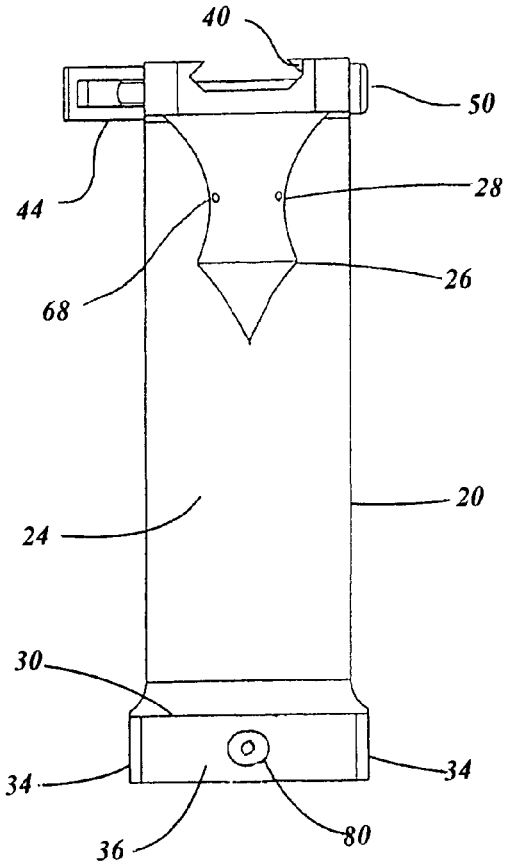
FIG. 8 a front view of the vertical foregrip pepper spray device in the preferred embodiment.

The hollow body 20 includes an integral base 30 which is used for resting on a solid surface and also to provide an extended surface for discharging the pepper spray away from an operator while eliminating any damage to the attached firearm. The integral base 30 incorporates a flat bottom surface 32, flat sides 34, a radial front surface 36 and a radial back surface 38, as depicted in FIGS. 3 though 8.

Figure 2:
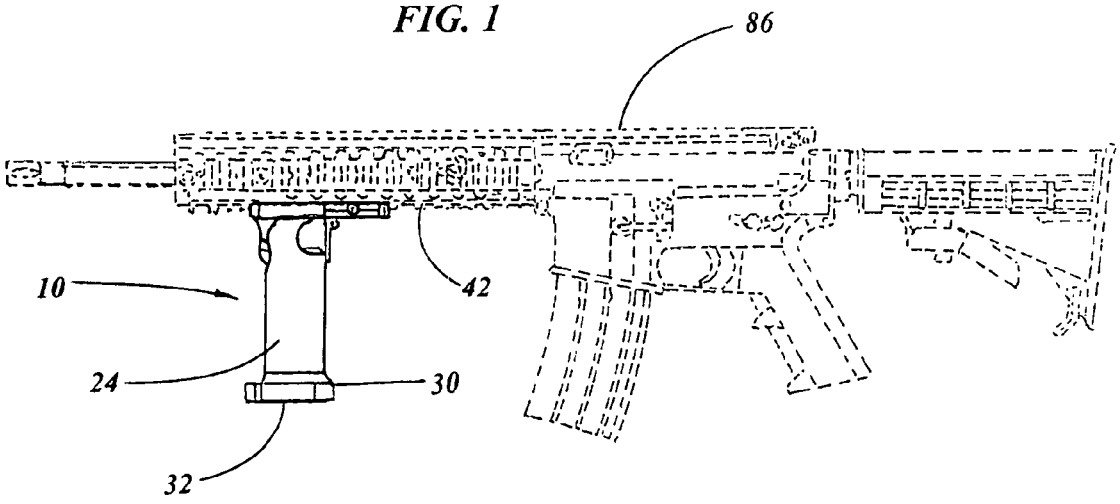
FIG. 2 is the vertical foregrip pepper spray device mounted on a modern sporting rifle.

A picatinny rail female groove 40 is formed into the hollow body 20 and is used to attach the device 10 onto a firearm picatinny rail 42, as illustrated in FIG. 2. A modern sporting rifle 86 normally contains a free float handguard with rails incorporated in a plurality of positions, further any conventional long gun may easily contain an to aftermarket picatinny rail 42 attached to the underside of the forestock. FIG. 2 illustrates a so called AR type of a modern sporting rifle and it is depicted in dashed lines as it is basically the workpiece for the device 10.

Figure 11:
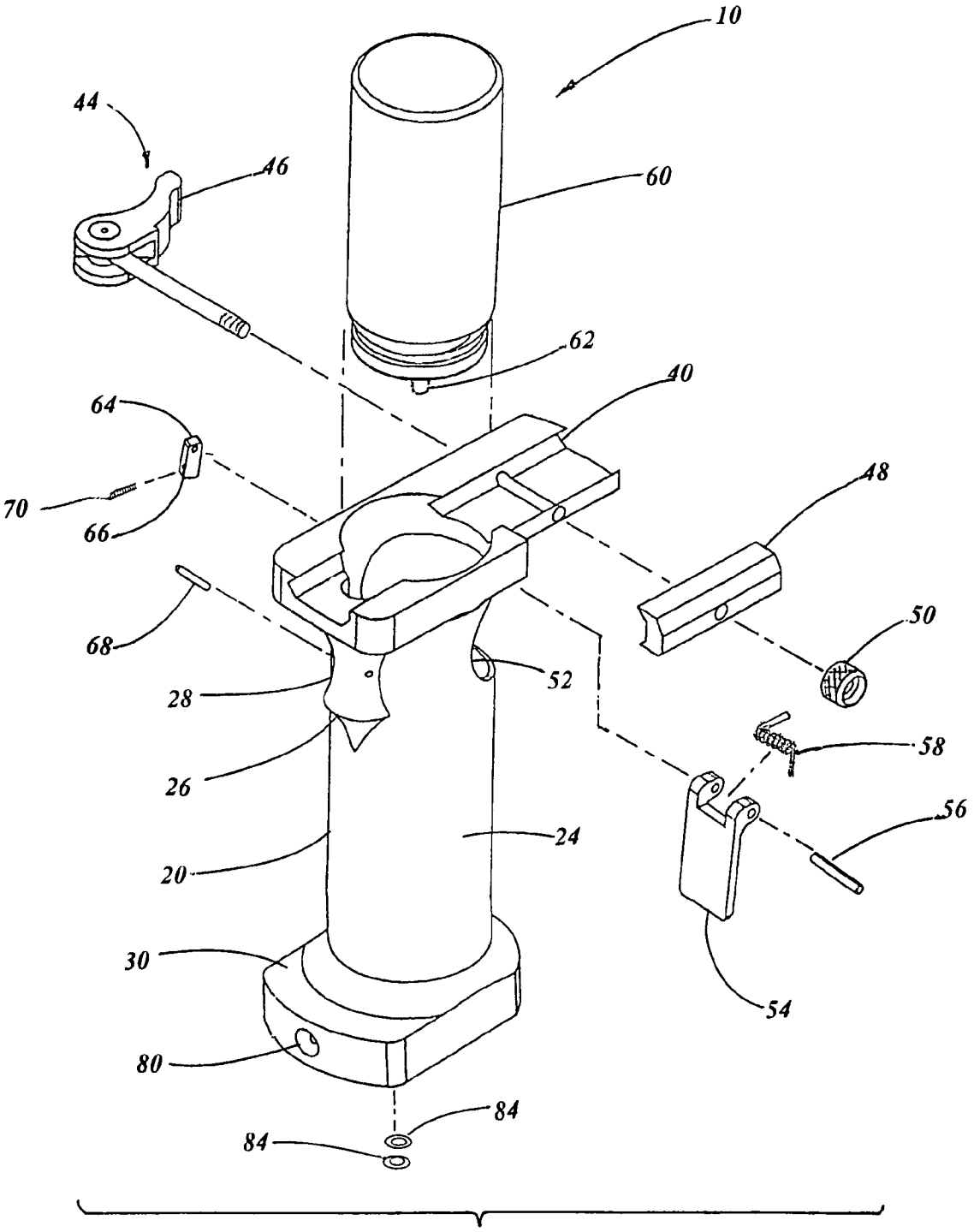
FIG. 11 is an exploded view partial isometric view of the vertical foregrip pepper spray device in the preferred embodiment.

The picatinny rail female groove 40 includes a quick release assembly 44; shown best in FIG. 11, for attachment to the rifle picatinny rail 42. The quick release assembly 44 comprises of an eccentric cam handle 46 with an attached threaded rod, a separate rail keeper 48 and a separate knurled nut 50.

An upper outside surface of said hollow body 20 has a thumb opening 52 permitting manual activation of the device 10. The thumb opening 52 is protected by a safety mechanism to eliminate accidental operation of the pepper spray device 10 therefore the safety mechanism blocks an aft end of the thumb opening 52. While the preferred safety mechanism consists of a safety door 54 it is anticipated that, any or all types, of equivalent safety devices may be used without difficulty. A myriad of safeties are well know in the art, such as a rotating safety, a sliding safety with detents, a wedge or bar block covering an opening, a sliding round pin, an eccentric cam, a manual lever, and the like. The preferred safety door 54, is shown in FIG. 9 and the exploded view of FIG. 11, and is hinged on the doors upper portion which is retained by a roll pin 56 along with a torsion spring 58 for holding the safety door 54 closed until it is manually opened with an operators thumb placed through the thumb opening 52.

A pepper spray pressurized aerosol container 60 is disposed, within the hollow of the body 20 and has a outlet stem 62 with the pepper spray media consisting of oleoresin capsicum (OC) pepper spray or related capsaicinoids (CN) or the preferred (CS) spray. The aerosol container 60 is retained in the hollow body 20 with a spring loaded latch consisting of a separate retaining latch 64 having a spring bore 66, a latch pin 68 and a compression spring 70 interfacing into the latch spring bore 66. During installation the container 60 forces the latch 64 to compress against the hollow body 20 until it is completely inserted when the latch 64 is urged by the spring 70 into a at rest position on top of the container 60 producing a locked condition.

Figure 9:
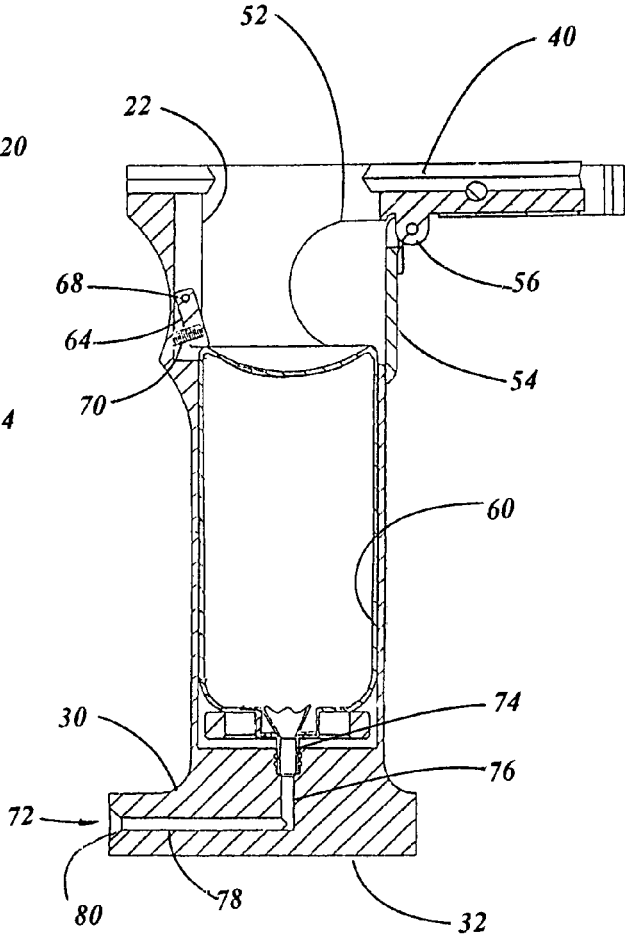
FIG. 9 is a cross sectional view taken along an imaginary centerline of FIG. 7.
Figure 10:
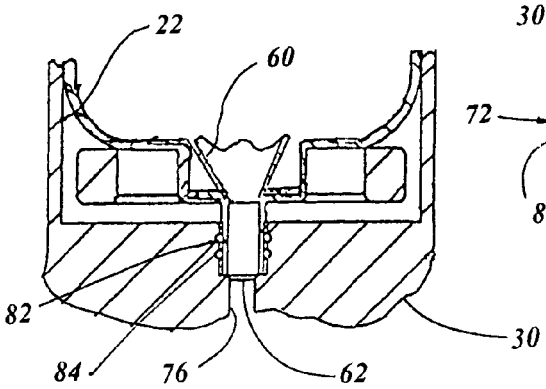
FIG. 10 is a partial enlarged portion of the vertical foregrip pepper spray device in the preferred embodiment.

A conduit 72 is formed within the integral base 30 for directing pepper spray from the aerosol container 60 to discharge in a forward direction from the base 30 of the pepper spray device 10, as depicted in cross section of FIG. 9. The conduit 72 has a stem chamber 74, a vertical conduit portion 76, a horizontal conduit portion 78 and a countersunk outlet spray orifice 80. The stem chamber 74 has at least one O-ring groove 82 with an elastomeric O-ring 84, preferably two, for isolating the pepper spray pressurized aerosol container 60 and the pepper spray outlet stem 62. As the pepper spray pressurized container 60 is under a constant force and the outlet stem 62 is spring loaded closed, when the container 60 is manually depressed the outlet stem 62 opens and the pepper spray is discharged until unconstrained.

In operation the device 10 may be activated and eject the pepper spray forward, the operator simply moves his thumb against the safety mechanism and inserts it through the thumb opening 52 formed in the body 20 moving the safety door 54 away against slight spring pressure. At the same time the operator presses the top of the container 60 downwardly until the outlet stem 62 is forced inwardly ejecting the pepper spray through the internal conduit 72 onto the outlet orifice 80.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A vertical foregrip pepper spray device comprising;

a) a hollow body providing a vertical gripping surface for an operator along with dispensing a volume of pepper spray from said device, b) an integral base on said hollow body for resting on a solid surface and to provide an extended surface away from an operator while eliminating damage to an attached firearm, c) said hollow body having an integrally formed picatinny rail female groove for attachment onto a firearm, d) an upper outside surface of said hollow body having a thumb opening to permit manual activation of said device, e) a pepper spray pressurized aerosol container, having a outlet stem, is disposed within said hollow of said body, wherein said a pepper spray pressurized container is replaceable and said outlet stem is spring loaded, such that when said outlet stem is urged inwardly pepper spray is discharged, and f) said integral base having a conduit formed within connecting pepper spray media from said aerosol container to a front portion of said base permitting front discharge from said device, such that an operator may safely discharge a non-lethal chemical irritant spray by manually depressing, with ones thumb, on a top surface of said pepper spray pressurized aerosol container with said device mounted on a picatinny rail beneath a modern sporting rifle or long gun.

2. The vertical foregrip pepper spray device as recited in claim 1 wherein said hollow body having a cylindrical portion, for manually gripping.

3. The vertical foregrip pepper spray device as recited in claim 1 wherein said hollow body further having a raised forefinger grip and an indentation integral with said hollow body outside surface.

4. The vertical foregrip pepper spray device as recited in claim 1 wherein said hollow body having a material selected from the group consisting of aluminum, impact resilient polymer and thermoplastic overmolded on a metallic body.

5. The vertical foregrip pepper spray device as recited in claim 1 wherein said integral base having a flat bottom surface, flat sides, a radial front surface and a radial back surface.

6. The vertical foregrip pepper spray device as recited in claim a 1 wherein said picatinny rail female groove further having a quick release assembly for attachment to a picatinny rail integrally formed with a modern sporting rifle or attached onto a tong gun.

7. The vertical foregrip pepper spray device as recited in claim 6 wherein said quick release assembly further comprises an eccentric cam handle rotatably attached to a threaded rod, a separate rail keeper and a separate knurled nut.

8. The vertical foregrip pepper spray device as recited in claim 1 wherein said thumb opening is protected by a safety mechanism for eliminating accidental operation of said pepper spray device.

9. The vertical foregrip pepper spray device as recited in claim 8 wherein said safety mechanism covers an aft end of said thumb opening.

10. The vertical foregrip pepper spray device as recited in claim 9 wherein said safety mechanism further comprises a safety door having a hinge on an upper portion retained by a roll pin with a torsion spring holding said safety door closed until manually opened with an operators thumb through said thumb opening.

11. The vertical foregrip pepper spray device as recited in claim 1 wherein said pressurized container pepper spray media is selected from the group consisting of oleoresin capsicum (OC) pepper spray and related capsaicinoids (CN) and (CS) spray.

12. The vertical foregrip pepper spray device as recited in claim 1 wherein said conduit within said base further having a stem chamber, a vertical conduit portion, a horizontal conduit portion and a countersunk outlet spray orifice.

13. The vertical foregrip pepper spray device as recited in claim 12 wherein said stem chamber having at least one O-ring groove with an elastomeric O-ring for isolating said pepper spray pressurized aerosol container and a pepper spray outlet stem.

14. The vertical foregrip pepper spray device as recited in claim 1 wherein said vertical foregrip pepper spray device is ambidextrous in that said thumb opening may permit either thumb to enter the device from either side and operate discharge of the pepper spray also the device may be secured by reversing said attachment to a firearm.

15. A vertical foregrip pepper spray device comprising;

a) a hollow body providing a vertical gripping surface for an operator along with dispensing a volume of pepper spray from said device, b) an integral base on said hollow body for resting on a solid surface and to provide an extended surface away from an operator while eliminating damage to an attached firearm, c) said hollow body having an integrally formed picatinny rail female groove for attachment onto a firearm, d) an upper outside surface of said hollow body having a thumb opening to permit manual activation of said device, e) a pepper spray pressurized aerosol container having a outlet stem, is disposed within said hollow of said body, wherein said pressurized aerosol container is retained in said hollow body with a spring loaded latch having a separate latch with a spring bore, a latch pin and a compression spring interfacing into said latch spring bore, such that installing said container forces said latch to compress against said hollow body until completely inserted when said latch is urged by the spring into an at rest position on top of said container achieving a locked condition, and f) said integral base having a conduit formed within connecting pepper spray media from said aerosol container to a front portion of said base permitting front discharge from said device, such that an operator may safely discharge a non-lethal chemical irritant spray by manually depressing, with ones thumb, on a top surface of said pepper spray pressurized aerosol container with said device mounted on a picatinny rail beneath a modern sporting rifle or long gun.

* * * * *